US005956825A

United States Patent [19]

McCoy et al.

[11] Patent Number: 5,956,825

[45] Date of Patent: Sep. 28, 1999

[54] REUSABLE CASKET ASSEMBLY

[76] Inventors: Steven N. McCoy, 3908 Randall Farm Rd., Atlanta, Ga. 30339; Donald G. Doiron, 1750 Tolleson Ct., Atlanta, Ga. 30338

[21] Appl. No.: 08/773,786

[22] Filed: Dec. 24, 1996

[51] Int. Cl.[6] ..... A61G 17/00

[52] U.S. Cl. ..... 27/2; 27/19

[58] Field of Search ..... 27/2, 3, 4, 5, 6, 27/7, 19, 20, 32, 35, 15

[56] References Cited

U.S. PATENT DOCUMENTS

| | | | |
|---|---|---|---|
| 458,527 | 8/1891 | Freshl | 27/14 |
| 3,050,818 | 8/1962 | Phillips | 27/32 |
| 3,654,676 | 4/1972 | McHugh | 27/2 |
| 4,823,448 | 4/1989 | Martin | 27/35 |
| 5,481,785 | 1/1996 | Minton et al. | 27/27 |
| 5,592,723 | 1/1997 | Leijonhufvud et al. | 27/2 |

*Primary Examiner*—Kien T. Nguyen

*Attorney, Agent, or Firm*—Jones & Askew, LLP

[57] ABSTRACT

Disclosed herein is an improved reusable casket assembly including an outer reusable casket and an inner liner or coffin adapted to permit conventional and traditionally burial of a deceased. The outer coffin is aesthetically appealing and constructed for secure and selectively fixed receipt of the inner liner. The inner liner is also aesthetically appealing. The inner liner may be used in either an open or closed condition for viewing. The inner liner may further be sealed while positioned within the outer casket, and either released into a burial vault or removed and placed into a mausoleum or crematorium. The invention includes selectively securable latches in combination with an alignment plate to facilitate secure placement of the casket assembly over a burial vault. The invention provides for lowering of the inner liner in a conventional manner into a burial vault, while preserving the outer casket for repeated, future use. The present invention further includes a sleeve fitted between the inner liner and the outer casket to provide a pleasing, unitary appearance.

26 Claims, 6 Drawing Sheets

REUSABLE CASKET ASSEMBLY

TECHNICAL FIELD

The present invention relates to burial caskets and, more particularly, to an improved reusable casket assembly that provides the aesthetic qualities of an expensive conventional casket, but at a lower cost to the bereaved. Described somewhat more particularly, the present invention relates to an improved reusable casket assembly that includes an outer decorative shell and an inner liner, wherein the inner liner may be selectively secured within or removed from the outer shell for burial of the deceased or cremation, as desired.

BACKGROUND OF THE INVENTION

It is well-known that conventional burial practice involves the use of a single casket. The deceased is placed in the casket, which is then used for a variety of purposes such as public viewing, burial or cremation. For example, the casket may be publicly viewed at a funeral service, wake or an assembly of family and other bereaved persons. In some instances, the casket may be opened to permit direct viewing of the deceased by those in attendance. At the conclusion of such assemblies, the casket may be transferred to a gravesite where, possibly after another service or like assembly, the casket may be lowered into the ground or a burial vault. The casket may, in fact, be transported to multiple services or assemblies in remote locations. For example, the gravesite may be a great distance from the service or funeral home, necessitating significant travel or transportation of the casket. As a further example, the family of the deceased may have burial services in two or more locations before a graveside service. Moreover, it is not uncommon for a casket and the interred deceased to be transported over great distances to multiple locations for multiple viewings, services or other assemblies.

Funeral arrangements may vary according to the traditions employed. One tradition is for the casket to be lowered into the ground opening or burial vault at the gravesite. Such lowering of the casket is conventionally accomplished by a lowering device having rollers and cross-straps. The straps are wound about the rollers and extend across the opening or the top of a burial vault or the ground into which the casket is to be lowered. The casket is placed on top of the rollers so as to be suspended above the vault or ground opening. The rollers are then turned, either mechanically or by hand, to unwrap the straps and correspondingly lower the casket into the hole or burial vault. Once the casket is in place, the straps are removed from underneath the casket and the casket sits directly on the ground or the vault floor.

There are various other traditions. For example, one known tradition permits family members or others to shovel dirt onto the casket prior to its eventual and final burial. In another tradition, the casket and deceased are cremated instead of being buried. In either event, the casket is used entirely for that deceased person and cannot be reused in any manner. Each of these traditions is critical to the bereaved who seek to honor the deceased in a manner acceptable to their respective faith and culture. Thus, a key consideration of purchasing or using a casket is that it offers the bereaved the opportunity to choose which tradition they think best to honor the deceased. Conventional caskets have consistently met this need.

The bereaved persons responsible for making funeral arrangements understandably seek to provide an aesthetically pleasing, decorative casket suitable for the particular tradition to be employed. Conventional caskets, however, are expensive items due to a variety of factors. One factor is the cost of materials. Conventional caskets are made of a wide range of materials including, but not limited to, steel, bronze copper or mahogany hardwood. A second consideration is labor cost. Top of the line conventional caskets are exceptionally decorative. It requires the finest craftsman and other skilled labor to produce such caskets. Thus, while the conventional casket has met the needs of consumers, they are expensive and the cost of such caskets has influenced the consumer, sometimes negatively.

At a time of bereavement, those persons attending to funeral and burial arrangements are faced with the tension of honoring the deceased at a cost commensurate with their or the deceased's financial capability. The purchase of an elaborate, decorative conventional casket is simply too great for many people. Accordingly, those persons who are making the funeral arrangements must often settle for a lower quality casket and forego the opportunity to conduct the services and assemblies mentioned hereinabove in the preferred manner. Furthermore, for casket manufacturers, the cost of the raw materials (steel, bronze, copper, mahogany, etc.) and skilled labor is ever increasing. As a result, the cost of conventional caskets to both the manufacturer and the purchaser continues to climb. Even so, competitive forces in the marketplace are forcing casket manufacturers and others in the industry such as jobbers and funeral directors to reduce profit margins on quality caskets. Thus, while the demand for quality caskets is still strong, the industry professional is incurring greater costs and reduced profits on the highest quality metal and hard wood caskets. As the cost of such high quality caskets increases, an ever increasing number of consumers are precluded from selecting the casket they would prefer to honor the deceased.

In order to address at least some of these problems, there have been several suggestions in the art for a reusable casket that addresses this tension. Reusable caskets providing an outer shell and an inner coffin for burial purposes have been proposed. There are many examples of such proposals, including U.S. Pat. Nos. 1,128,865; 3,050,818; 2,289,406, 3,133,334; 3,613,189; 3,654,676; 3,810,282; 3,815,185; 4,063,337; 4,139,929; 4,151,630; 4,177,543; 4,237,590; 4,249,289; 4,265,006; 4,337,556; 4,727,632; 4,788,757; 5,349,727 and 5,481,785. The structures disclosed in these patents could potentially achieve the intended result. For example, U.S. Pat. No. 3,050,818 shows a combination of an outer casket with a detachable base or an outer bottomless casket and an inner casket. As a further example, U.S. Pat. No. 5,481,785 discloses an inner capsule preferably molded of curable plastic that is retained by pins within an ornate outer shell.

These devices permit reuse of the outer shell. More particularly, each of these and the other prior art devices attempt to overcome the problem of expense by providing inexpensive inner liners capsules with reusable outer decorative shells. However, these prior art devices fail to offer the range of traditions afforded by conventional caskets and, perhaps more importantly, further fail to present a quality casket in which funeral directors can assure the integrity of burial services while offering a choice of quality caskets of traditional appearance and quality. For example, cremation is becoming an increasingly popular burial tradition. Many of these reusable caskets fail to accommodate this tradition. Many of these reusable caskets further fail to adequately permit lowering of the inner liner into the ground or a burial vault in such a manner as to maintain the dignity associated with this tradition. Further, as modern society becomes even more mobile and extended families are dispersed about greater areas, many gravesites are significantly distanced from the funeral home. The cost of transporting a conventional casket over any meaningful distance is significant.

A critical concern to burial service professionals such as funeral directors and the like is the integrity of the burial service. The industry professional seeks to minimize any intrusion into the service so that the focus remains on honoring the deceased. Thus, any unnecessary interruption or needless handling of the casket is avoided. Of course, it is imperative that the casket perform as intended so as not to cause embarrassment or other awkwardness. A significant concern with many reusable caskets as identified above involves placement of the deceased into the ground or a burial vault. It is unseemly to place the combined unit into the ground and then retrieve the outer shell. It is desirable to lower the deceased into the ground or vault with a minimum number of steps. In other words, it is desirable to lower the portion of a reusable casket into the ground without need for removing the outer shell in full public view. Further, several of these reusable caskets did not adequately insure against any inadvertent disassembly or the casket while the unit was suspended over a ground opening or burial vault. It is believed that such concerns have in large part prevented funeral professionals from utilizing such reusable caskets.

Moreover, many reusable caskets fail to address the need for localized transportation of the reusable assembly about a funeral home or church, etc. Such localized transportation is typically accomplished on a cart or the like. The casket, oftentimes including the deceased, is placed upon the cart, which is in turn wheeled about the facility for placement in a particular location. Such transportation is often done in full view of the family or even at a service in the presence of many hundreds of attendees. Obviously, the potential for inappropriate handling of the deceased is increased in such assemblies as bottomless coffins and similar other prior art reusable devices are proposed. The funeral corrector and all others associated with the burial must be able to insure the integrity of the coffin and, accordingly, the burial service. Similar considerations exist for travel over great distances. While such travel may not necessarily be in front of family members or others, it is nonetheless unseemly for the deceased to be disturbed in the event of shipment by rail, air or other means of transportation. For these and other reasons, the trade has been slow to accept reusable caskets, regardless of potential cast savings to both the consumer and the industry.

Accordingly, there is a need in the art for an improved reusable casket assembly that not only addresses the cost issue, which has heretofore been recognized, but which also provides the ability to address various traditions in a dignified manner typically associated with conventional caskets. Such other traditions include cremation and dignified lowering of the casket into a burial vault or the ground through use of conventional equipment. Further, there is a need in the art for a reusable casket that recognizes and addresses the costs associated with transportation of the assembly on both a local and remote basis.

SUMMARY AND OBJECTS OF THE INVENTION

The present invention fulfills the above-described shortcomings in the prior art by providing a reusable casket assembly that offers not only the aesthetic benefits of a conventional casket, but is furthermore flexible so as to address various traditions in a dignified manner while providing consumer savings without reducing profit margins for those offering quality caskets and related funeral services.

Generally described, the present invention comprises an outer casket shell and an inner liner and a sleeve, wherein the shell is adapted for receipt of the liner and includes means for immobilizing the shell and liner on top of a casket lowering apparatus and the sleeve creates the appearance of a traditional casket. In addition, a further aspect of the present invention is the provision of means for immobilizing the shell and liner in such a manner as to ensure the integrity of the resulting unit while on top of a casket lowering apparatus, a mobile cart or in other transportation devices. When desired, the inner liner may be released from the outer shell and, by means of a conventional lowering apparatus, placed into a burial vault in the ground.

Described somewhat more particularly, one preferred embodiment of the invention comprises an outer decorative casket shell and an inner liner, the outer shell having interconnected side and end walls together with a top, a retractable immobilization device operatively associated with the outer shell and means for suspending the inner liner within the shell, the liner comprising a bottom, side and end walls interconnected for receipt of a deceased. In this embodiment of the invention, the casket assembly may be securely held over a burial opening or vault by means of the immobilization device and, when desired, the immobilization device may be retracted and the inner liner lowered in the opening or vault for burial. The outer shell may be retrieved at a later time and reused by another consumer.

In another preferred embodiment of the invention, also described somewhat more particularly, the present invention comprises an outer decorative shell and an inner liner assembly comprising a top liner section and a bottom liner section, wherein the bottom liner section comprises a base plate that extends across the bottom opening of the outer shell, and the top liner receive the deceased for internment. The bottom liner aligns the top liner within the inner shell and ensures that the deceased is not mishandled or that the casket assembly is inadvertently disassembled during use. The bottom liner section is also configured so as to engage a mobile cart or the like to guard against mishandling of either the deceased or the casket assembly during localized or remote transportation. In this alternative preferred embodiment, the outer shell is again reusable and the inner liner, including both sections thereof, may be buried by conventional lowering equipment or cremated with the body of the deceased.

The present invention thus provides a reusable casket assembly comprising an inner liner and an outer shell. The outer shell may be of the highest quality and reused so as to gain efficiency and economy associated with such reuse. The inner liner may be readily transported for multiple use, whether at multiple services or viewings. Once delivered to a second location for use, the liner may be associated with a second shell (of either the same or perhaps a different outer shell design) for reuse by the family or other bereaved persons. The inner liner may be double-sealed such that, after burial, the possibility for the introduction of any outside contaminants to the deceased is substantially reduced or eliminated. The inner liner may also be made of a material that is amenable to cremation. In such an event, the inner liner would be destroyed but the decorative outer shell would still be available for reuse. The deceased is interred in a manner that eliminates certain labor intensive jobs performed by funeral staff but does not detract from the integrity of the burial service, regardless of the tradition employed.

The present invention thus addresses the high cost of conventional caskets and the difficulties found in proposed reusable caskets. The present invention includes an immobilization device that, in conjunction with a conventional lowering apparatus, ensures that the reusable casket will be properly suspended above a ground opening or a burial vault and facilitates lowering of the inner liner (or the entire assembly if so desired) into the burial vault or opening. The outer shell may further include means for retaining the inner liner within the outer shell in such a manner as to ensure against inadvertent disengagement of the inner liner from the outer shell during transportation of the assembly. Such retaining means may further include means for selective release of the inner liner to facilitate either placement of the casket onto the straps of a conventional lowering apparatus, cremation, placement within a mausoleum or transportation to another location. Yet other features of the present invention include means for securing the liner and outer shell during localized transport of the casket assembly on a mobile cart or the like, and means for positively fixing the position of the immobilization device to ensure against failure or inadvertent restriction during use.

Accordingly, it is an object of the present invention to provide an improved reusable casket assembly.

It is a further object of the present invention to provide an improved reusable casket assembly with equal quality of that associated with conventional high quality caskets.

It is a further object of the present invention to provide an improved reusable casket assembly that ensures the quality and integrity of the burial service by guarding against manhandling of the deceased, the casket assembly and the associated devices such as mobile carts and the like.

It is a further object of the present invention to provide an improved reusable casket assembly that ensures the quality and integrity of the burial service regardless of the tradition employed ranging from conventional burial to cremation.

It is a further object of the present invention to provide an improved reusable casket assembly with an inner liner that is designed to be interchangeable with numerous outer caskets that are similar or identical in appearance to conventional or traditional caskets typically utilized by funeral homes.

It is a further object of the present invention to provide an improved reusable casket assembly with an inner liner for burial that is designed so as to be transferable to different outer caskets so as to accommodate more than one memorial service held in different locations for a deceased.

It is a further object of the present invention to provide an improved reusable casket assembly with an inner liner for burial that is designed so as to be transferable to different, high quality outer shell caskets that may be of a different design or made of a different material.

It is a further object of the present invention to provide an improved reusable casket assembly with inner liners made of various materials including metal, wood, plastic, fiberboard or other appropriate material so as to accommodate traditional burials and cremations.

It is a further object of the present invention to provide an improved reusable casket assembly with inner liners made of various materials including metal, wood, plastic, fiberboard or other appropriate material so as to reduce transportation costs associated with the transfer of conventional caskets and even proposed reusable casket assemblies.

It is a further object of the present invention to provide an improved reusable casket assembly with an outer casket to prevent accidental reopening during a service, handling or travel.

It is a further object of the present invention to provide an improved reusable casket assembly that both immobilizes the inner liner after insertion into the outer casket and immobilizes the outer casket when suspended over a vault or ground opening prior to lowering the inner liner.

It is a further object of the present invention to provide an improved reusable casket assembly that both immobilizes the inner liner after insertion into the outer casket and immobilizes the outer casket when suspended over a vault or ground opening prior to lowering the inner liner.

It is a further object of the present invention to provide an improved reusable casket assembly to immobilize an inner liner and an outer casket so as to be suitable for conventional transport of the casket and liner on movable dollies typically found in funeral homes.

It is a further object of the present invention to provide an improved reusable casket assembly with an inner liner that creates the appearance of a unitary casket assembly.

It is a still further object of the present invention to provide an improved reusable casket assembly that positively secures an upper portion of the inner liner to the outer casket in such a manner as to have an outward- appearance that is identical to traditional locking devices typically used with such caskets.

It is a still further object of the present invention to provide multiple, identical outer shells such that, in the event transport of the deceased over a significant area is necessary, one shell may be removed by the sending facility, the liner transported and another, identical outer shell utilized by a receiving facility for burial.

It is a further object of the present invention to provide an improved reusable casket that is not readily inadvertently disassembled.

It is a further object of the present invention to provide an improved reusable casket having a reusable outer casket shell and multiple, identically-configured inner liners so as to reduce storage space necessary at a funeral home or the like to store various conventional caskets of the same design.

It is a still further object of the present invention to provide a reusable casket assembly that permits observance of multiple traditions, including cremation, in a dignified manner typically associated with conventional caskets.

These and other objects, features and advantages of the present invention will become apparent from reading the following specification when taken in conjunction with the accompanying drawings.

BRIEF DESCRIPTION OF THE DRAWINGS

While the specification concludes with claims, particularly pointing out and distinctly claiming the subject matter which is regarded as the present invention, it is believed that the invention, objects, features and advantages thereof will be better understood from the following detailed description taken in conjunction with the accompanying embodiment of the drawings, in which:

DETAILED DESCRIPTION

Figure 1:
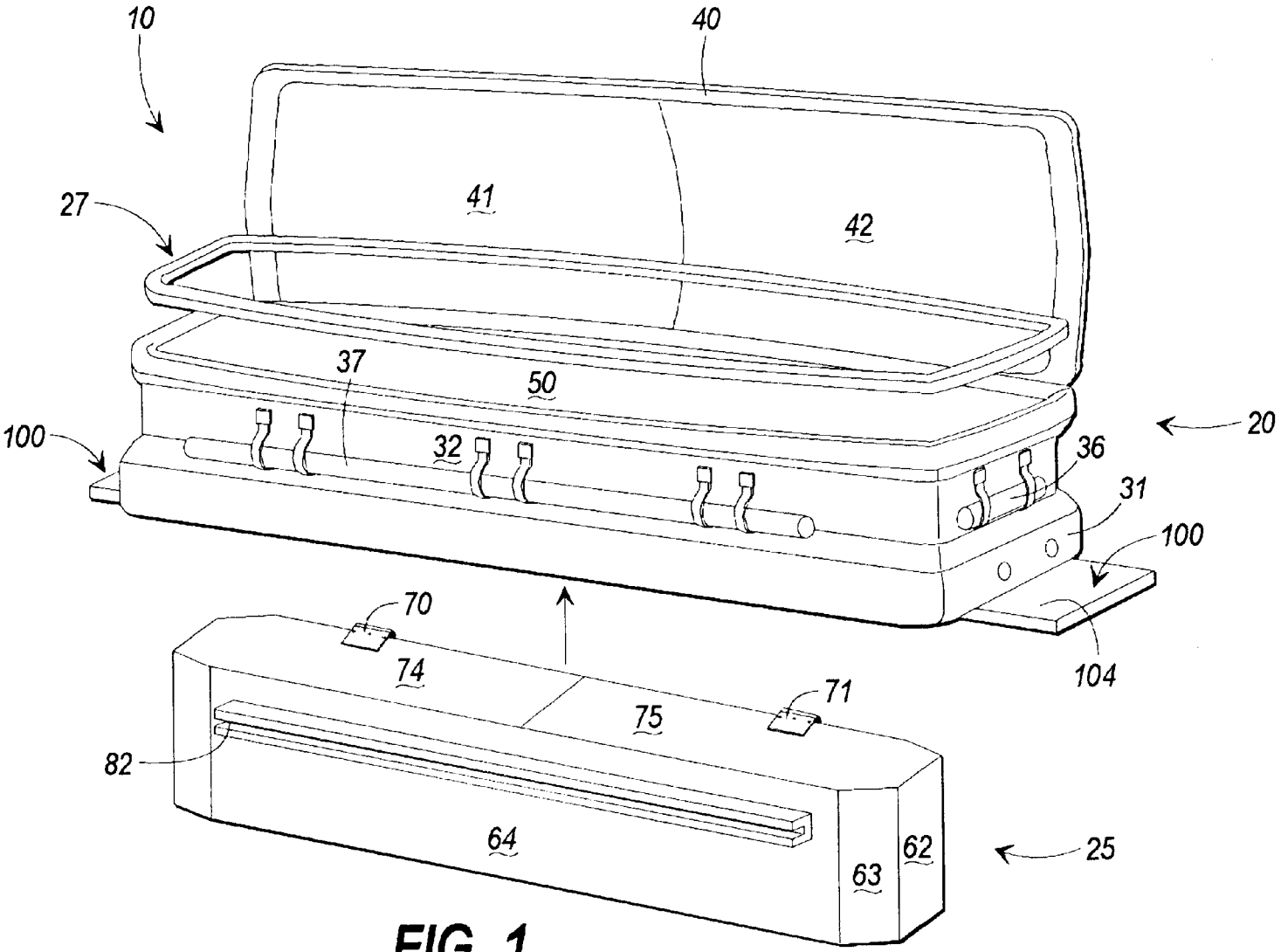
FIG. 1 is a perspective view of an improved reusable casket assembly in accordance with the present invention.

Referring now in more detail to the drawing figures, in which like numerals indicate like parts throughout the several views, FIG. 1 shows an improved reusable casket assembly 10 in accordance with the present invention. The assembly 10 includes an outer casket shell 20 and an inner liner 25 and a sleeve 27. The outer casket shell 20 is defined by four walls 30, 31, 32 and 33. Wall 32 defines the front of the casket shell 20. As in conventional caskets, the shell 20 includes handles 36 and 37 secured onto walls 31 and 32, respectively. Walls 30 and 33 are similarly provided with respective handles 35 and 38, which are not shown in this figure because they are substantially identical to handles 36 and 37. The outer shell further includes a top 40, defined by two sections 41 and 42. The top 40 is pivotally mounted upon the rear wall 30 by hinges (not shown) so the top may be opened as shown for viewing. Such a construction is well-known in the art and need not be further disclosed herein. Top sections 41 and 42 may be closed independently of each other. Thus, for example, section 42 may be closed to permit viewing of only a portion of the deceased. Such a construction is also well-known in the art and need not be disclosed further herein. The outer shell walls 30–33 create and define a cavity 50.

As described in greater detail hereinbelow, the cavity 50 is of sufficient dimension to receive the inner liner 25 or, in an alternative embodiment, a top inner liner section 125 that is operatively associated with a bottom liner section 130, all as described below. It is to be appreciated that the inner liner may be various configurations, including oval design, or any other configuration so long as it receives a deceased individual and can be retained within the cavity as set forth herein. Referring thereto in greater detail, the cavity 50 is bottomless so that, for example, the inner liner 25 may be received entirely thereby. Accordingly, regardless of the inner liner's 25 configuration, it is preferably received in such a manner by the cavity 50 of the outer shell 20.

The sleeve 27 includes a horizontal component 28 and a vertical component 29. These elements are preferably integrally formed, but may be provided in any suitable manner. The sleeve rests on the top surfaces of the inner liner 25 and the outer shell 20 to obscure or cover any gap between the inner liner 25 and the outer shell 20, as shown in the exploded view of FIG. 1. Those of ordinary skill in the art will appreciate that the sleeve 27 fulfills a need by creating the appearance of a traditional casket as also described hereinbelow.

Figure 2:
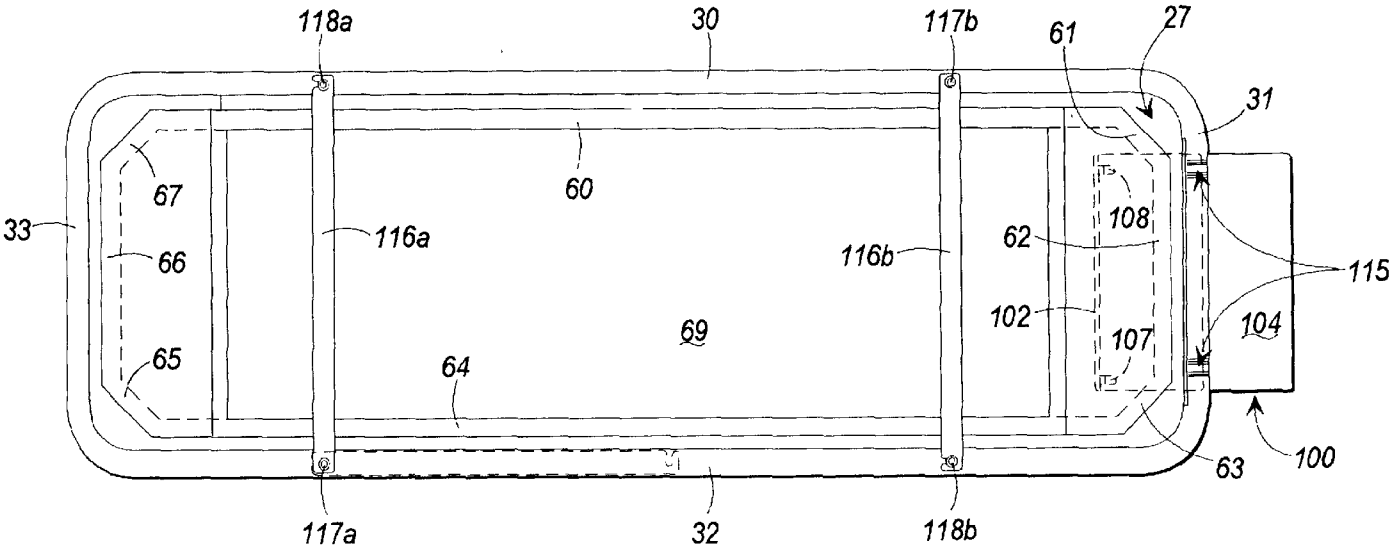
FIG. 2 is a bottom view of the embodiment shown in FIG. 1.

Turning to FIG. 2, the inner liner 25 defines eight walls 60, 61, 62, 63, 64, 65, 66 and 67, a top 68 and a bottom 69. While the dimensions of the inner liner may vary, the liner 25 is sized to receive features of the invention. The inner liner 25 defines an interior containment area 72 in which the deceased is placed. The interior containment area 72 is of sufficient dimension to receive not only the deceased, but any other appropriate materials including but not limited to a decorative liner, a head rest or a foot rest. The top 68 of the liner 25 is secured by hinges 70 and 71 (see FIG. 1). If desired, the hinges 70 and 71 may be affixed to the interior of the liner 25 to conceal their presence. Moreover, the top 68 is provided in separate sections 74 and 75 which, in a manner similar to that of the outer shell top 40 to permit introduction of the deceased into the liner 25 and viewing of the deceased, if desired. (See FIG. 1.) One of ordinary skill in the art will appreciate that the liner 25, as well as the outer casket shell 20, may be sealed to prevent the introduction of water or other contaminants to the deceased. Such sealing is well known in the art and need not be disclosed further herein.

It will be appreciated by those of ordinary skill that the outer shell 20 is decorative and constructed to appear as a traditional casket. Accordingly, the outer shell 20 is aesthetically pleasing in appearance and is preferably made of fine or superior materials. For example, the shell 20 may be made of mahogany or steel or other suitable materials which include bronze, copper, other metals, hard woods and certain plastics, ceramics and compositions including any of these materials. For aesthetic purposes, it is contemplated that the sleeve 27, preferably a substantially "t-shaped" element as shown in FIG. 4A, would be made of a material identical to that of the outer shell 20. In other words, if the outer shell is made of mahogany, the sleeve 27 would likewise be made of mahogany. The hardware including such items or the handles may be made of various materials, including brass, silver, gold, etc.

As noted above, the inner liner 25 defines an interior containment area 72 in which the deceased is placed. The interior containment area is of sufficient dimension to receive not only the deceased, but any other appropriate materials including but not limited to a decorative liner, a head rest or a foot rest. The use of such devices is known in the art and need not be further disclosed herein. The inner liner may be made of various materials, including wood, plastic or any other suitable material, depending on the eventual use. Those of ordinary skill will appreciate that the material selected may be dictated by the particular tradition to be followed. For example, if the inner liner 25 is to be cremated, it is preferably made of wood or some like combustible material. Other traditions may call for other materials. If the inner liner 25 is to be placed in the ground and the bereaved intend to shovel dirt into the grave, a different material such as plastic or a lesser quality wood may be in order.

Figure 3:
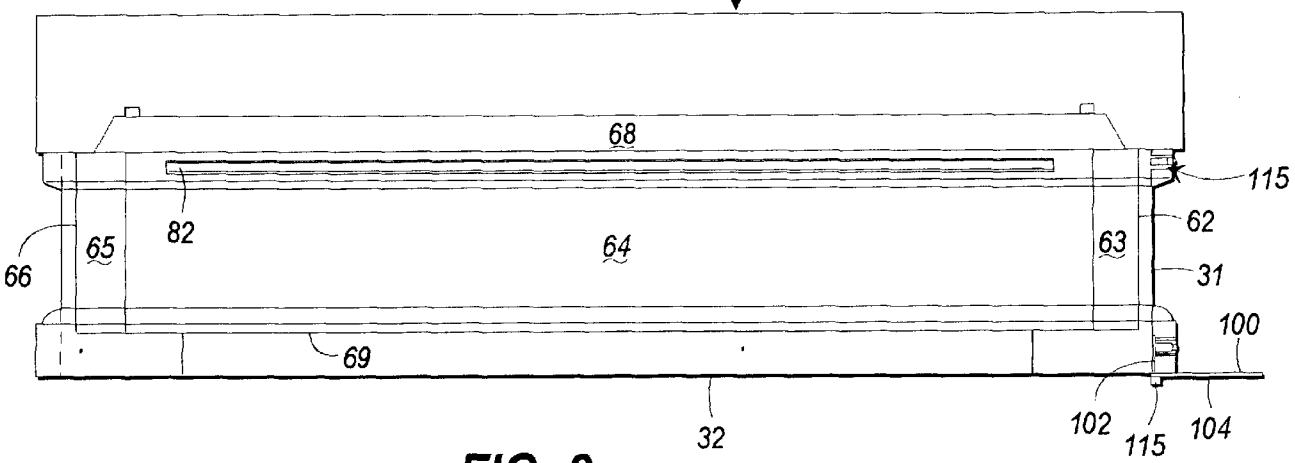
FIG. 3 is a side view of the embodiment shown in FIG. 1.

Referring to FIGS. 1 and 3, it is seen that the inner liner 25 is provided with two channels 82 and 84 fixedly secured to liner walls 60 and 64, respectively. As described in greater detail below, the channels facilitate suspension of the inner liner 25 within the cavity 50 of the outer shell 20. The channels 82 and 84 may be made of steel or any other material of suitable strength that fulfills this purpose. The channels 82 and 84 may be secured in place by welding, attachment bolts or any other device sufficient to secure each channel to its respective wall surface 60 and 64 (or to any other wall surface as desired) to achieve the suspension discussed below. The suspension mechanism is described in greater detail with reference to the embodiment shown in FIG. 6.

Referring particularly to FIGS. 1–3, the outer shell 20 includes at least one immobilization pad 100. As shown in FIG. 1, each end wall of the outer shell 20 may be provided with an immobilization pad 100. Since they are otherwise identical in construction, only one is described in detail herein. The immobilization pad 100 is generally L-shaped, having a substantially vertical plate 102 and a substantially horizontal plate 104 that is integrally connected to the bottom of the vertical plate 102. The vertical plate 102 does not extend beyond the outer shell wall 31. Instead, as shown in FIG. 3, the vertical plate 102 can be placed flush against the inside of wall 31 of the outer shell 20 when the pad 100 is in an extended position. The pad 100 may also be withdrawn so that the horizontal plate 104 does not extend beyond outer shell wall 31. (See phantom lines in FIG. 2.) In this manner, the travel span of the pad 100 is defined. It is therefore to be understood that the immobilization pad 100 is retractable in a substantially horizontal plane. When retracted, the vertical plate 102 and the horizontal plate 104 are both entirely withdrawn behind outer shell wall 31 so that the immobilization pad 100 is unseen. When extended, the vertical plate 102 is pressed flush against the inside of shell wall 31 and the horizontal plate 104 projects beyond shell wall 31, all as shown in FIG. 2. The horizontal plate 104 slides through a retaining plate 115 described in greater detail below.

The vertical plate 102 is provided with two preferably integral male extensions 107 and 108. The male extensions 107 and 108 are aligned with two female receptacles 110 and 111 defined in shell wall 31. The female receptacles 110 and 111 are configured to receive and retain the male extensions 107 and 108 in a conventional manner. For example, the receptacles 110 and 111 may be provided with spring-loaded detents that clasp and retain the male extensions 107 and 108. Alternatively, the male extensions 107 and 108 may be fitted with coaxially-mounted springs (not shown) to bias the extensions. Extending the pad 100 to the outermost position (as shown in FIG. 3) would compress the springs. The extensions 107 and 108 would enter the receptacles 110 and 111, where they are captured by respective detents, thus locking the extensions within the receptacles and securing the immobilization pad 100 in the extended position. To withdraw the immobilization pad 100, the extensions 107 and 108 would be disengaged from their respective receptacles 110 and 111 and the plate 104 is slid through an aperture defined by a retaining plate 115 provided at the base of wall 31.

Referring in detail to FIG. 2, it is seen that retaining bars 116*a* and 116*b* are provided to ensure that the inner liner 25 does not withdraw inadvertently from engagement with the outer shell 20. The bar 116*a* pivots about a pin 117*a* in a known manner. In like fashion, bar 116*b* pivots about a pin 117*b*. Bar 116*a* is retained in its operative position by a pin 118*a* secured within wall 30 of the outer shell 20. Similarly, bar 116*b* is retained in its operative position by a pin 118*b*. It is to be understood that the distal ends of the bars 116*a* and 116*b* that engage pins 118*a* and 118*b* respectively are configured to fixedly secure the position of said bars.

Figure 4:
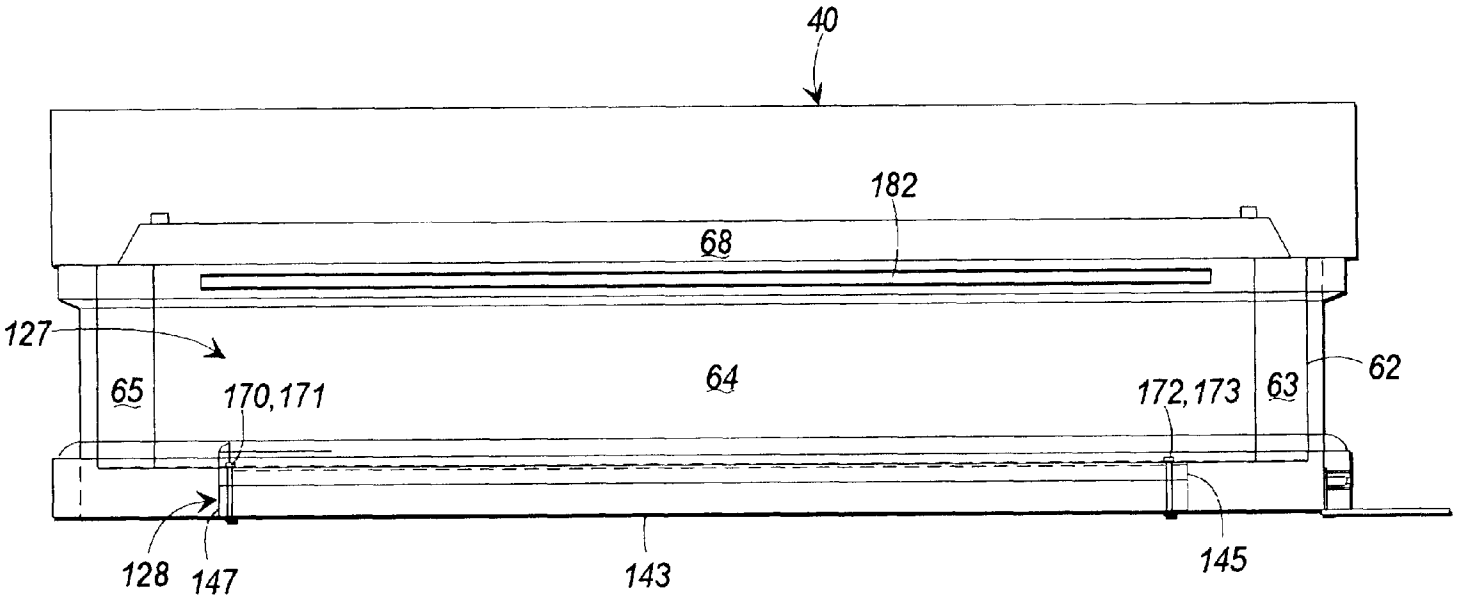
FIG. 4 is a side view of another preferred embodiment of an improved reusable casket in accordance with the present invention.
Figure 4A:
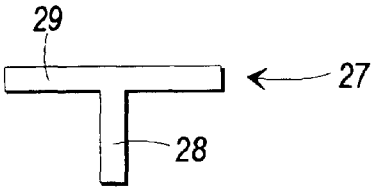
FIG. 4A is a section view of the sleeve utilized in the preferred embodiments of the present invention.
Figure 5:
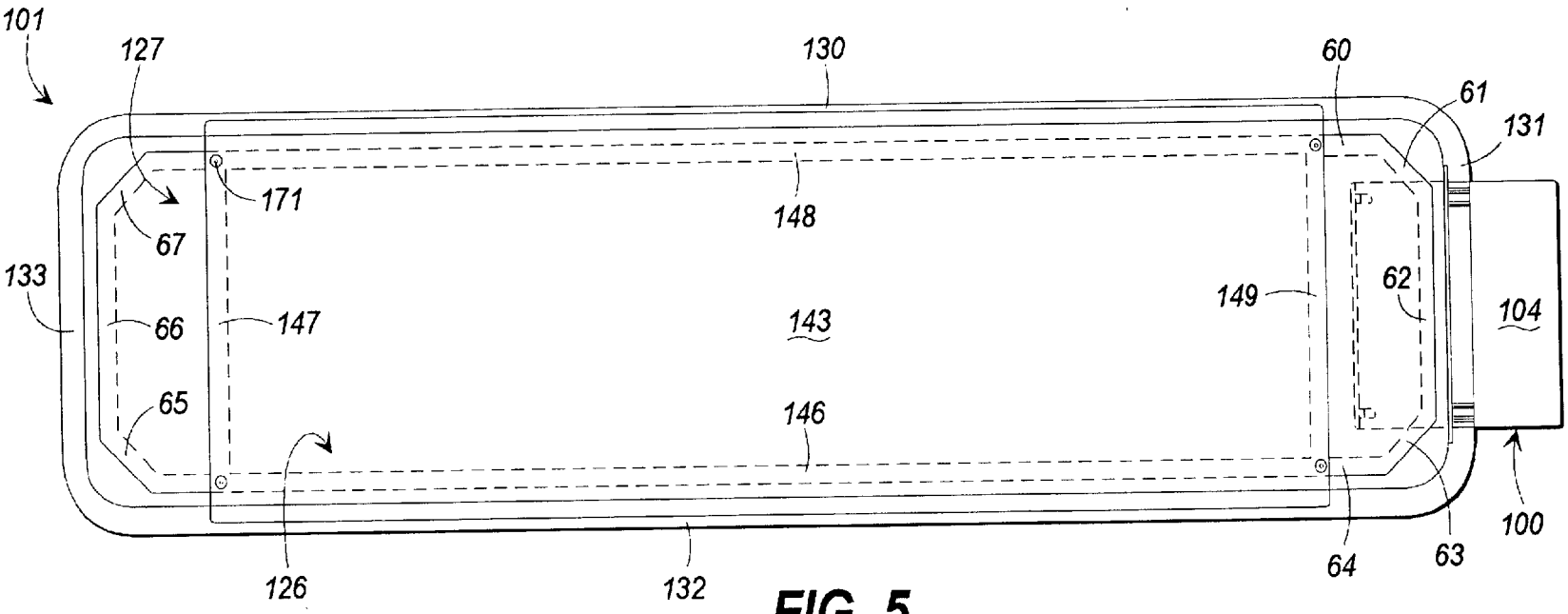
FIG. 5 is a bottom view of the preferred embodiment shown in FIG. 4.
Figure 6:
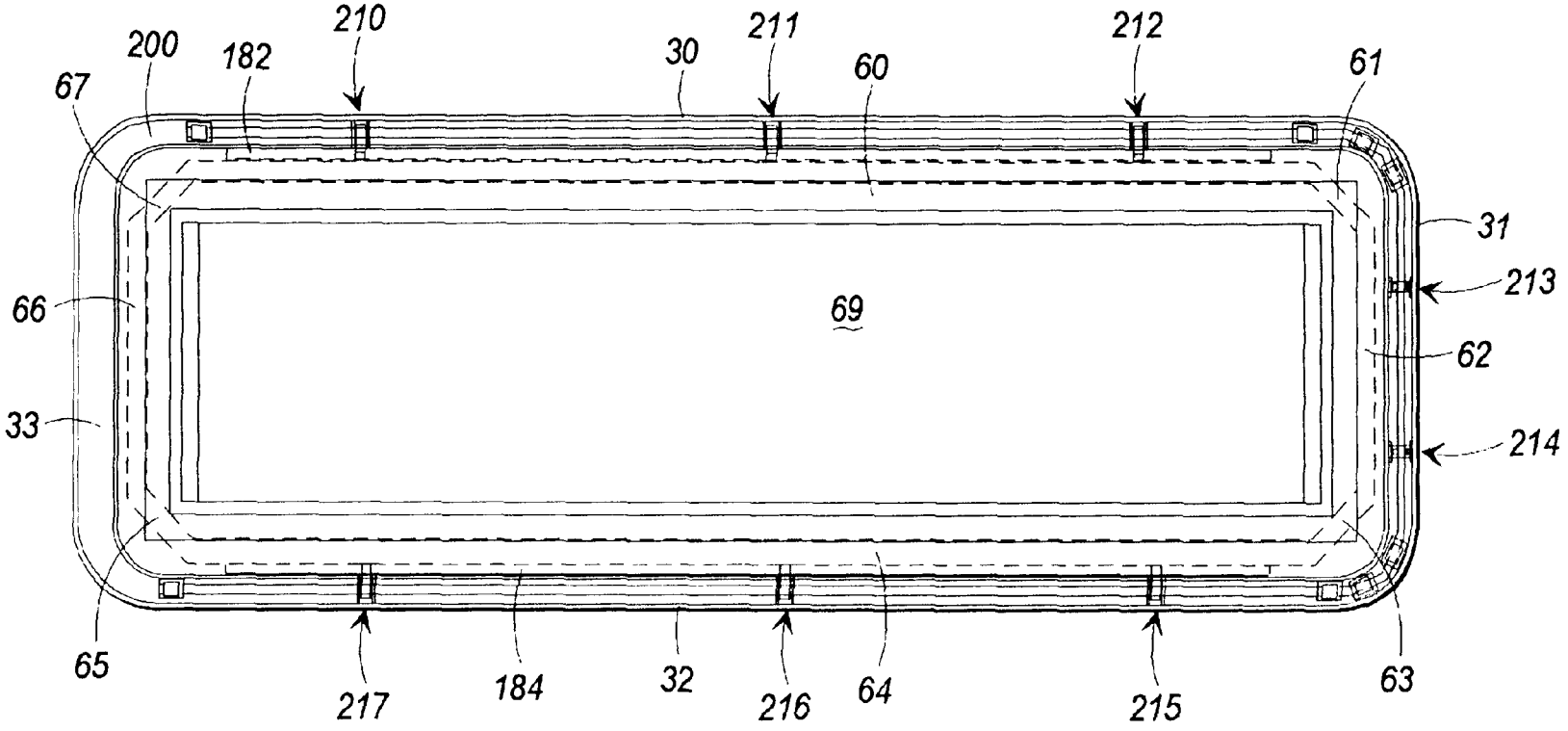
FIG. 6 is a bottom view of a preferred embodiment of an outer shell and inner liner in accordance with the present invention, particularly showing the gear assembly for securing the casket inner liner within the outer shell.

FIGS. 4, 5 and 6 show an alternative preferred embodiment of the present invention shown generally at 101. The inventors state that this embodiment contemplates the best mode known to the inventors of accomplishing the invention. Referring in more detail thereto, FIG. 4 shows a casket assembly 10 according to the present invention with an outer casket shell 120 and an inner liner 125. The inner liner 125 provides a upper inner liner 127 and a bottom inner liner 128. The inner liner 127 is provided with walls 60, 61, 62, 63, 64, 65, 66 and 67 as described in reference to the previous embodiment. Each of these and the other elements are described in detail as follows. The outer casket shell 120 is defined by four walls 130, 131,132 and 133. Wall 132 defines the front of the shell 120. The casket shell 120 may include conventional handles and the like in a manner disclosed above for the previously disclosed embodiment. The outer shell 120 further includes a top 140. The top 140 may be provided in two sections as disclosed above, or may be a unitary member. The walls 130–133 define a cavity 150 that, as disclosed below, receives the deceased and the upper inner liner 127 and the bottom inner liner 128.

Figure 5A:
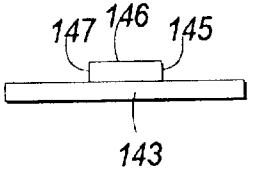
FIG. 5A is a section view of the bottom liner section shown in FIG. 5.

The bottom inner liner 128, as viewed in FIG. 5 and FIG. 5A, provides an extended base portion 143 integrally connected with four raised walls 145, 146, 147, and 148. The top of the walls 145–148 contact the bottom of the walls of the inner top liner as described in greater detail below. The bottom inner liner 128 is preferably made of steel, metal or a hardwood of sufficient strength to support the other portions of the reusable casket assembly 101. The bottom inner liner 128 defines four apertures 150, 151, 152 and 153. These apertures 150–153 are suitable to receive four bolts 160, 161, 162 and 163 that, as explained herein, secure the bottom liner 128 and guard against inadvertent disassembly of the casket 10'. The bolts 160–163 positively secure the bottom inner liner 128 to the upper inner liner 127. It will be appreciated that this connection may be made using threaded or tapped openings in the upper inner liner 128 or by nuts 170, 171, 172 and 173 (as shown in FIG. 5) or by any other suitable means. The bottom inner liner 127 is preferably of sufficient dimension to receive the deceased. Moreover, the bottom inner liner's base 143 is a flat surface that may be readily placed on a cart or other mobile transport device. In this manner, the bottom inner liner 127 guards against the inadvertent mishandling of the deceased that could conceivably result from the use of a multiple part casket.

The upper inner liner 127 may be secured within the outer shell 120 in a manner as described hereinabove regarding the inner liner 25. Accordingly, the upper inner liner 127 is provided with two channels 182 and 184 fixedly secured to the upper liner walls 190 and 194, respectively. As described in greater detail below, the channels facilitate suspension of the upper inner liner 127 within the cavity 150 of the outer shell 120. The channels 182 and 184 may be made of steel or any other material of suitable strength that fulfills this purpose. The channels 182 and 184 may be secured in place by welding, attachment bolts or any other device sufficient to secure each channel to its respective wall surface 190 and 194 to achieve the suspension discussed below.

As show in FIG. 4, the outer shell 120 is provided with the immobilization pad 100. As described earlier, the outer shell 120 may be provided with more than one pad 100. Because all such pads are identical in construction, only one is described in detail. Thus, by use of such pads 100, the outer shell 120, as fitted with the upper inner liner 127 and the bottom inner liner 128, can be suspended over an opening or a burial vault for conventional burial as described hereinbelow.

The four walls 30, 31, 32 and 33 of the inner liner 25 and the walls 130, 131, 132 and 133 of the upper inner liner 128 define an inner channel 200. Since these assemblies are otherwise identical, only one is shown and described in detail herein. The channel 200 receives two elongated worm gear assemblies 205 and 206 that cooperate with a plurality of positive, spring-loaded locking lugs 210, 211, 212, 213, 214, 215, 216 and 217, as shown in the drawing figures. Activation of the worm gear 205 causes the lugs to be moved inwardly into the channels 80–84 and 180–184 fixedly secured to the walls of the inner liner 25 and the upper inner liner 127, respectively. The worm gears 205 and 206 are directed about the curved portions of the channel 200 by a series of universal connections 220–227. More specifically, universal joint connectors 220, 221, 222 and 223 are provided with gear assembly 205 and universal joint connectors 224, 225, 226 and 227 are provided with gear assembly 206. It will be appreciated that once the worm gear assemblies 205 and 206 are activated, the lugs 210–217 are driven by their respective springs to be inserted in the c-shaped channels 82 and 84 or 182 and 184 so as to suspend the inner liner 25 or the upper inner liner 127 within the respective cavities 50 or 150. It is to be further appreciated that the primary lugs 213 and 214 act as the activation devices for the gear assembly 206. Such activation is accomplished by use of other universal connections 230 and 231 in combination with smaller worm gears that are accessible from the exterior of the outer shell 20 by means of a hex-head fitting or the like. It is to be further appreciated that a like universal connection is provided at the location of each lug 210–217 in order to translate the action of the gear to that of the lug itself. In this manner, the lug can be inserted or withdrawn from the c-channels 182 and 184. Such an arrangement is well known in the art and the details thereof are beyond the scope of this invention. In this manner, it is seen that the inner liner 25 and the upper inner liner 127 and lower inner liner 128 receive a deceased. Once done, the liner 25 or the upper and bottom inner liner 127 and 128, is placed within the cavity, 50 or 150 and the casket may be used as intended and described below. It will be appreciated by those of ordinary skill that this two-part liner 25 can be readily used for cremation of a deceased. In so doing, it is preferred that the liner be placed together but not secured with bolts or like unburnable materials. In such an instance, it is possible to glue or use other detents such as posts or the like to secure the liner sections one to the other in order to effect cremation.

Figure 7:
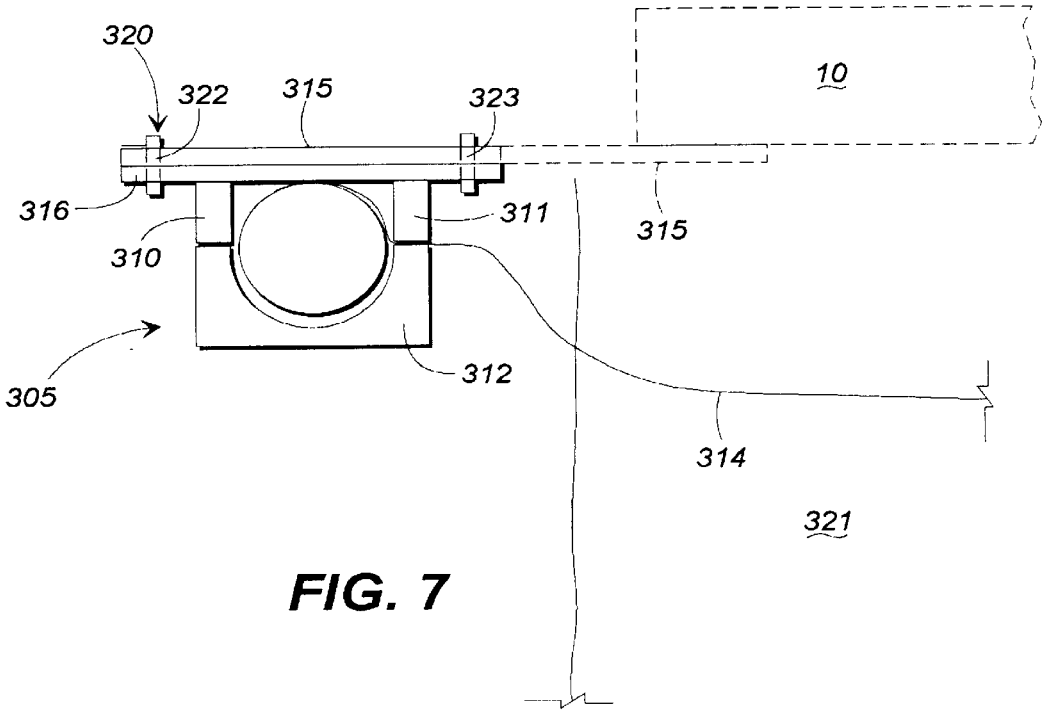
FIG. 7 is a side view of a conventional lowering device fitted with the immobilization device of the present invention.

The present invention further contemplates that the immobilization pad 100 may be provided in conjunction with the lowering rack assembly and its associated equipment. Referring in more detail to FIG. 7, an alternative retractable immobilization device is illustrated having a roller 300 operatively secured within the lowering rack assembly 305. The rack assembly 305 further includes a strap 314 that extends out of the roller 300 to engage a casket 10 in the usual manner. The strap 314 is also wrapped around the roller 300 for the purpose of lowering the casket into an opening in the ground or a burial vault 321. This alternative embodiment provides an immobilization pad 315 that sits upon a supporting surface 316, which is fixedly secured to the side supports 311 and 312 in any suitable manner, including by welding or other means. The pad 315 is retained in position by a cotter pin 320. As shown, the pad 315 can be extended and secured by pin 320 so as to ensure that the casket 10 or the inner liner 25 of the present invention (either inner liner 25 of the combination of inner liner 127 and 128) does not inadvertently separate or fall into the opening or the vault 321. In operation, pin 320 is removed from a first aperture 322 that passes through both the pad 315 and the support surface 316. The pad 315 is then free to be moved outwardly from its position over the roller 300 into place over the burial opening 321, as shown in platform in FIG. 7. Once in this extended position, pin 320 is inserted into aperture 323. This fixes the position of the pad 315 and insures that the pad is secure. Accordingly, the pad 315 is able to support the casket 10 and facilitate eventual lowering of the entire casket or only the inner liner 25.

The outer casket shell 120, like the outer casket shell 20 of the previous embodiment, is preferably a decorative unit of the finest workmanship. In use, the consumer is able to select a particular outer shell 20 or 120. In use of the first embodiment with the inner liner 25, the deceased is placed in the inner liner 25 which is, in turn, placed in the cavity 50 of the outer shell 20. It is to be understood that the outer shell 20 suspends the inner liner 25 by means of the c-shaped channels 82, 84 and 182, 184. More particularly, the worm gears 205 and 206 are activated by rotation of the primary lugs 213 and 214 found in wall 31 or 131 of the outer shell 20 or 120, respectively. Turning of these primary lugs 213 and 214 may be manually accomplished by a hex-head arrangement or the like. Rotation of the lugs 213 and 214 cause a rotation of their respective work gears 205 and 206. As each gear 205 and 206 is manipulated, such action in turn causes the lugs 210–212 and 215–217, respectively, to be inserted into the c-channels 182 and 184 (or 82 and 84). This activation thus causes the lugs to positively engage the "c" channels secured to the walls of the inner liner 25. The inner liner 25 and the outer shell 20 are thus joined and can be moved as a unit. In order to remove the inner liner 25 or 125 from the outer shell 20 or 120, the primary lugs 213 and 214 are rotated in the other direction. This causes a reverse operation of the lugs 210–212 and 215–217 so as to withdraw the lugs from the c-channels 182 and 184 (or 82 and 84).

To insure that the inner liner 25 does not disengage from the outer shell 20, the outer shell is provided with two retaining bars 116*a* and 116*b*. The bars 116*a* pivot about two respective pins 117*a* and 117*b*. The opposite ends of the bars 116*a* and 116*b* are provided with slots 118*a* and 118*b* that, in order to secure the bars in an operative position, are fixed about detents 119*a* and 119*b* respectively. The casket 10 is thus assembled and readied for a service or burial. If the deceased is to be buried, the assembled casket 10 is transported to a gravesite. It will be appreciated that either the casket shell 20 and the liner 25 may be transported, or the liner itself may be transported. This latter method is particularly suited for transportation of the deceased over significant distances, as it will be significantly cheaper to transport only the liner and the deceased instead of the entire assembly 10. In this case, an identical shell 20 may be provided at the receiving end or, if desired, the person responsible for arrangements at the receiving end can use a different shell 20. At the gravesite, the casket assembly 10 is placed on the straps 314 and suspended over the opening or the burial vault.

The immobilization pad 100 is extended so as to rest on the supports 305 of the lowering device. Such an arrangement ensures that the inner liner 25 will not separate from the outer shell 20. At the appropriate time, the funeral attendants release the bars 116*a* and 116*b* and unlock the spring loaded lugs 210–217 so that the inner liner 25 falls onto the straps 314. The rollers 300 are then manipulated so as to lower the inner liner 25 into the ground. The outer shell 20 remains above the gravesite until removal is desired. Once removed, the bereaved may employ any of the traditions commonly associated with conventional caskets such as shoveling dirt onto the casket (liner) or tending to burial of the casket (liner).

Use of the alternative embodiment is similar to that described above only that the deceased is loaded into the inner bottom liner 128 and then the upper inner liner 127 is secured thereto by virtue of the bolts 170–173. The outer shell 120 is then secured about the combined liners 127 and 128 so as to place the liners within the cavity 150. The locking lugs are engaged and the reusable casket assembly is prepared for use as described.

Figure 8:
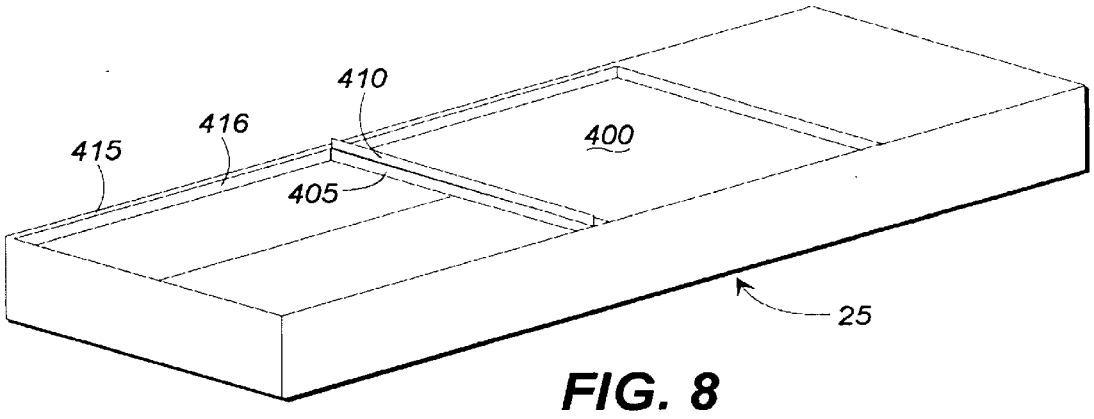
FIG. 8 is a perspective view of an inner liner showing a telescopic lid arrangement for an inner liner in accordance with the resent invention.

The inner liners 25 (or the components 127 and 128 of the two-piece liner) may be made of suitable materials for cremation, such as wood. Moreover, the inner liner 25 or the upper inner liner 127 may be provided with a telescopic or sliding lid. As shown in FIG. 8, an inner liner 25 is provided with a lid 400 made of two components sections 405 and 410. Section 410 sits over section 405. The lid components 405 and 400 rest in small channels 415 and 416 defined in the interior of the lid walls near the top thereof. More specifically, lid section 405 rests in opposing channels 415 and lid section 410 rests in opposing channels 416. The channels 415 and 416 are offset relative one to another such that the components 405 and 410 can be slid one over the other. As shown in the drawing, when the lid components 405 and 410 are slid toward the base or foot of the inner liner 25, the components 405 and 410 rest below the remaining portion of the inner liner top so as to be entirely removed from view. Such an arrangement permits viewing of the deceased even when the body has been placed in the inner liner 25. A related arrangement provides for lid sections 405 and 406 to be removable from the liner 25. In this way, a similar result for viewing is obtained. Upon burial, the lids are replaced to create the necessary airtight seal. Thus, the present invention contemplates that the tradition of viewing the deceased, in a manner similar to that long practiced with conventional caskets, may also be practiced in use of the present invention.

It is to be appreciated that in either embodiment, the outer shell 20 or 120 is available for reuse. As a result, the price charged the consumer will be less because the funeral professional will be able to recoup the investment made in the outer shell through repeated use thereof. Because the consumer is able to pay a lesser price for a high quality casket, the consumer will be more inclined to utilize such a casket so as to honor the deceased in the desired manner. The funeral professional will also be able to benefit from the present invention because repeated use of the outer shell will increase the return on the initial investment therein.

While this invention has been described in detail with particular reference to preferred embodiments thereof, it will be understood that variations and modifications can be effected within the spirit and scope of the invention as described hereinbefore and as defined in the appended claims.

What is claimed is:

1. An improved reusable casket, comprising:

a decorative shell comprising a bottomless container having four walls and a top;

an inner liner suitable for placement within said decorative shell so as to form a reusable casket, said inner liner defining a bottom, four walls and a top; and a sleeve supported by said decorative shell in such a manner as to obscure any gap between the inner surfaces of said decorative shell and the outer surface of said inner liner to thereby create the appearance of a traditional casket.

2. The reusable casket of claim 1 wherein said sleeve comprises a t-shaped element configured to rest upon either an upper surface of said decorative shell wall or said inner liner.

3. The reusable casket of claim 1 wherein said liner comprises an upper liner section and a lower liner section configured to be placed together such that said lower section is fixedly secured to a portion of said upper liner section and said upper liner section is suitable for receipt of a deceased individual.

4. The reusable casket of claim 1 wherein said inner liner comprises a decorative unit suitable for public viewing and placement within said decorative shell.

5. An improved reusable casket, comprising:

a decorative shell comprising a bottomless container having four walls and a top;

an inner liner suitable for placement within said decorative shell so as to form a reusable casket, said inner liner defining a bottom, four walls and a top; and means mounted upon either of said decorative shell or said inner liner for immobilization of said decorative shell, whereby upon placement of said shell and inner liner over a burial vault or opening, said immobilization means ensures the integrity of said casket so as to prevent inadvertent lowering of said decorative shell into said vault or opening.

6. The reusable casket of claim 5, wherein said immobilization means comprises a retractable pad operatively secured to an interior surface of said decorative shell, said pad being movable from a first position withdrawn inside said shell and to a second position extended from said shell for engagement with a lowering rack.

7. The reusable casket of claim 6 further comprising means for securing said inner liner within said outer shell, said securing means including a plurality of locking lugs selectively movable from said outer shell into engagement with said inner liner.

8. The reusable casket of claim 7 further comprising a channel fixedly secured to said inner liner for receipt of said locking lugs.

9. The reusable casket of claim 7 further comprising a gear in operative engagement with each of said locking lugs and means for initiating said gear such that, upon activation of said gear initiation means, said gear engages said locking lugs and drives said lugs into engagement with said inner liner.

10. The reusable casket of claim 9 wherein said gear initiation means comprises one of said locking lugs.

11. The reusable casket of claim 9 wherein said gear initiation means further comprises a release of such that upon reversal of said lugs as to disengage said lugs from said channel and permit release of said decorative shell from said inner liner.

12. The reusable casket of claim 7 further comprising at least one retaining bar extending from the bottom of a first one of said walls to the bottom of a second one of said walls to thereby retain said inner liner within said shell.

13. The reusable casket of claim 5 wherein said inner liner top comprises a first top section and a telescopically connected second top section, where said first top section is aligned for sliding into a position underneath or above said second top section to permit open viewing of a deceased in a conventional manner and sliding of the first section back into an original position for burial.

14. The reusable casket of claim 5 wherein said inner liner top comprises a first top section and a removably connected second top section with the first section being aligned for sliding into a position under or above said second section to permit open viewing of a deceased in a conventional manner and placement of the first section back into an original position for burial.

15. The reusable casket of claim 5 wherein said inner liner top that is hinged to permit viewing of a deceased in a conventional manner.

16. An improved reusable casket, comprising:

a decorative outer shell comprising a bottomless container having a front wall, a back wall and two end walls, and a top mounted upon said back wall to permit viewing of a deceased;

said decorative outer shell further comprising a plurality of first spring-loaded pin assemblies provided in said first wall and said back wall, and interconnected by a gear secured within a channel defined in said walls, said first assemblies each comprising a pin extending through its respective wall and adapted to move between a first engaging position and a second withdrawn position;

an inner liner for receipt of a deceased person comprising a sealed enclosure having four walls, a bottom and a selectively openable top, said inner liner including a channel for locking receipt of said first pin assemblies; and a retractable immobilization pad mounted upon the interior of said end walls of said decorative outer shell by at least one spring-loaded pin assembly, said spring assembly comprising a pin extending through said end wall and adapted to move between a first locked position to secure said pad in an extended position and a second locked position to secure said pad in a withdrawn position, whereby, upon placement of said decorative outer shell about said inner liner, said first pin assemblies are inserted into said channel defined in said inner liner to secure said inner liner within said outer decorative shell to form a unitary casket.

17. The improved reusable casket of claim 16 further comprising a sleeve suitable for insertion between said decorative outer shell and said inner liner.

18. The reusable casket of claim 16 where said liner comprises an upper liner section and a lower liner section configured to be placed together such that the lower section is secured to fix the portion of the upper liner section and the upper liner section is suitable for receipt of a deceased individual.

19. An improved reusable casket, comprising:

a decorative outer shell comprising a bottomless container having four side walls and a top;

an inner liner comprising a first liner section and a second liner section configured to be placed together, said first liner section defining a base plate of sufficient dimension to engage the bottom of said outer shell four side walls and defining a plurality of apertures, said second liner section defining a plurality of apertures aligned with said first liner section apertures; and a plurality of retaining bolts suitable for insertion with said first section apertures and said second section apertures to form said inner liner, whereby, upon placement of a deceased within said inner liner, said outer decorative shell is secured about said inner liner to form a unitary, reusable casket.

20. The reusable casket of claim 18 further comprising:

means mounted upon either of said decorative shell or said inner liner for immobilization of said decorative shell, whereby upon placement of said shell and inner liner over a burial vault or opening, said immobilization means insures the integrity of said casket so as to prevent inadvertent lowering of said decorative shell into said vault or opening.

21. The reusable casket of claim 19, wherein said immobilization means comprises a retractable pad operatively secured to an interior surface of said decorative shell, said pad being movable from a first withdrawn position inside said shell and to a second extended position for engagement with a lowering rack.

22. The reusable casket of claim 20 further comprising means for securing said inner liner within said outer shell, said securing means including a plurality of locking lugs selectively movable from said outer shell into engagement with said inner liner.

23. The reusable casket of claim 21 further comprising a channel fixedly secured to said inner liner for receipt of said locking lugs.

24. The reusable casket of claim 21 further comprising a gear in operative engagement with each of said locking lugs and means for initiating said gear such that, upon activation of said gear initiation means, said gear engages said locking lugs and drives said lugs into engagement with said inner liner.

25. The reusable casket of claim 23 wherein said gear initiation means comprises a worm gear suitable for engagement with said lugs to drive said lugs into engagement with said channel.

26. The reusable casket of claim 21 further comprising at least one retaining bar extending from the bottom of a first one of said walls to the bottom of a second one of said walls to thereby retain said inner liner within said shell.

* * * * *